US009541931B2

(12) United States Patent
Kohama

(10) Patent No.: US 9,541,931 B2
(45) Date of Patent: Jan. 10, 2017

(54) REGULATOR CIRCUIT AND INTEGRATED CIRCUIT DEVICE FORMING THE REGULATOR CIRCUIT

(71) Applicant: FUJI ELECTRIC CO., LTD., Kawasaki-shi (JP)

(72) Inventor: Takanori Kohama, Matsumoto (JP)

(73) Assignee: FUJI ELECTRIC CO., LTD., Kawasaki-shi (JP)

( * ) Notice: Subject to any disclaimer, the term of this patent is extended or adjusted under 35 U.S.C. 154(b) by 30 days.

(21) Appl. No.: 14/246,449

(22) Filed: Apr. 7, 2014

(65) Prior Publication Data

US 2014/0306675 A1 Oct. 16, 2014

(30) Foreign Application Priority Data

Apr. 12, 2013 (JP) ..... 2013-084019

(51) Int. Cl.
*G05F 1/56* (2006.01)
*G05F 1/567* (2006.01)
*G05F 1/565* (2006.01)

(52) U.S. Cl.
CPC ..... *G05F 1/56* (2013.01); *G05F 1/562* (2013.01); *G05F 1/565* (2013.01); *G05F 1/567* (2013.01)

(58) Field of Classification Search
CPC ..... G05F 1/56
USPC ..... 323/273, 280
See application file for complete search history.

(56) References Cited

U.S. PATENT DOCUMENTS 5,943,224 A * 8/1999 Mao ..... H02H 7/125 365/52
6,043,705 A * 3/2000 Jiang ..... H02M 1/4208 327/589
6,055,186 A * 4/2000 Hung ..... G11C 16/30 365/185.18
6,677,736 B1 * 1/2004 Barnes ..... G05F 1/40 323/280
9,401,705 B2 7/2016 Kohama et al.
2002/0000758 A1 * 1/2002 Song ..... H05B 37/0209 307/116
2005/0141292 A1 * 6/2005 Do ..... G11C 5/147 365/189.11
2006/0012451 A1 * 1/2006 De Cremoux ..... G05F 1/46 333/216
2006/0203400 A1 * 9/2006 Bodano ..... G05F 3/30 361/18
2010/0289562 A1 11/2010 Kohama et al.
2012/0104964 A1 * 5/2012 Hughes ..... H05B 33/0848 315/291

(Continued)

FOREIGN PATENT DOCUMENTS

JP S59-96828 A 6/1984
JP 2004-129413 A 4/2004

(Continued)

*Primary Examiner* — Matthew Nguyen
*Assistant Examiner* — Trinh Dang
(74) *Attorney, Agent, or Firm* — Rabin & Berdo, P.C.

(57) ABSTRACT

A regulator circuit that makes it possible to supply a voltage which enables a load circuit to operate normally, even if an external power supply voltage is momentarily interrupted or dropped, includes a ZD/R parallel circuit (a backflow prevention diode and in parallel with a resistor) that is connected between an external power supply voltage terminal and the drain of a MOSFET.

6 Claims, 15 Drawing Sheets

(56) References Cited

U.S. PATENT DOCUMENTS

| | | | | |
|---|---|---|---|---|
| 2014/0009134 | A1* | 1/2014 | Bernardon | H02M 1/36<br>323/284 |

FOREIGN PATENT DOCUMENTS

| | | | |
|---|---|---|---|
| JP | 2009-265955 | A | 11/2009 |
| JP | 2010-288444 | A | 12/2010 |
| WO | WO 2013-005443 | A1 | 1/2013 |

* cited by examiner

REGULATOR CIRCUIT AND INTEGRATED CIRCUIT DEVICE FORMING THE REGULATOR CIRCUIT

CROSS-REFERENCE TO RELATED APPLICATION

This application claims the benefit of foreign priority of Japanese application 2013-084019, filed Apr. 12, 2013, the disclosure of which incorporated herein by reference.

BACKGROUND OF THE INVENTION

1. Field of the Invention

The present invention relates to a regulator circuit used in a power conversion device such as an internal combustion engine ignition device, and to a semiconductor integrated circuit device forming the regulator circuit. More particularly, the invention relates to a regulator circuit wherein it is possible to output a voltage which enables a load circuit (one or more circuits serving as a load of the regulator circuit) to operate normally despite a momentary interruption or momentary drop of an external power supply voltage, and to a semiconductor integrated circuit device forming the regulator circuit.

2. Description of the Prior Art

FIG. 8 is a main portion circuit diagram of a commonly used regulator circuit 500 which lowers an external power supply voltage VB. With, for example, a band gap reference circuit used as a reference voltage circuit 55, it is possible to make an output voltage VREG of the regulator circuit 500 a stable voltage to which is added a reference voltage VREF division ratio of resistors (a first resistor 65 and second resistor 66) by using a reference voltage, having no temperature dependence (the reference voltage actually has some temperature dependence, but it is taken here that it has no temperature dependence), which is generated from the reference voltage circuit 55. By setting a current flowing through an MOSFET 56 (an enhancement type n-channel type MOSFET) connected to an external power supply voltage terminal VB into which an external power supply voltage is input (a terminal into which is input an external power supply voltage such as a battery voltage) to be equal to or higher than a current flowing through a load circuit 70, it is possible to make the output voltage VREG of the regulator circuit 500 a set voltage VREG0 which is a constant voltage. It is possible to raise the VREG from the low external power supply voltage VB by using a depression type MOSFET as the MOSFET 56.

Of the reference signs in FIG. 8, 52 is a positive terminal of an operational amplifier 51, 53 is a negative terminal of the operational amplifier 51, 54 is an output terminal of the operational amplifier 51, 57 is a drain of the MOSFET 56, 58 is a source of the MOSFET 56, 59 is a gate of the MOSEFT 56, 65 is the first resistor, 66 is the second resistor, 67 is a first connection point, 68 is a second connection point, 69 is an output terminal of the regulator circuit 500, VB is the external power supply voltage, and VDD is a power supply which drives the operational amplifier 51.

FIGS. 9A and 9B are diagrams showing a behavior of the VB when momentarily interrupted in the regulator circuit 500 of FIG. 8, wherein FIG. 9A is a waveform diagram of the VB, while FIG. 9B is a waveform diagram of the VREG. Herein, the VB is substantially equal to the VREG in a range from VB=0V until the VB rises, but when an enhancement type MOSFET is used, there is originally a region in which the VB drops by the amount of the threshold voltage of the enhancement type MOSFET. An operation of a depression type MOSFET is shown for the sake of simplification. When the VB falls below the VREG and drops to, for example, 0V, the VREG also drops to 0V following the VB. In normal operation, an unshown capacitor (which is small in capacitance particularly when the load circuit is configured of a semiconductor integrated circuit) configuring each of the load circuit 70 is in a condition in which it is charged with the VREG. When a momentary interruption occurs in the VREG, electric charge with which the capacitor is charged is discharged via the external power supply voltage terminal (VB terminal) to an external power supply (battery) side, thus reverse charging the unshown external power supply.

When the capacitor is low in capacitance, the discharge is carried out so that the VREG follows the drop of the VB. When the VB drops drastically, the VREG also drops drastically, and a minimum voltage VREG2 of the VREG reaches 0V. When a VREG1 shown by the broken line is set to be a voltage which enables the load circuit 70 to operate normally, it is difficult for the load circuit 70 to operate normally at a point at which VREG2<VREG1. The load circuit 70 has a logic circuit incorporated therein and, for example, a latch circuit configured of the logic circuit cannot maintain a normal state, thus causing malfunction such as latch release.

FIG. 10 is a diagram showing VB dependence of the VREG. This shows VB dependence when the regulator circuit 500 starts operating and stops operating.

The regulator circuit 500 starts operating, and when the VB rises gradually from 0V, the VREG rises following the VB. Because of this, the VB and VREG rise in a relationship of VREG=VB. VREG=VREG0 at a point at which the VB reaches the VREG0, and the VREG is the VREG0 and a constant voltage in a condition in which VB>VREG0. Normally, the regulator circuit 500 operates at the VREG0. Herein, for example, the circle indicates an operating point.

Meanwhile, when the VB drops to 0V from a voltage higher than the VREG0 in a stop and transitional state of the regulator circuit 500, VREG=VREG0 when VB≥VREG0, while VREG=VB in the range of VREG0>VB=0V, and the VREG drops to 0V following the VB.

FIG. 11 is a diagram showing temperature dependence of the VREG. The temperature dependence of the VREG is such that the VREG has no temperature dependence and is flat when using a reference voltage with no temperature dependence, such as of a band gap reference circuit, as previously described. Because of this, the VREG at the operating point coincides with the VREG0, and the VREG is of a constant value without changing with a rise and drop in temperature.

Also, it is disclosed in JP-A-59-96828 (FIG. 2) that, in a parallel redundant system direct current power supply device including a backflow prevention diode on the output side, by adopting a configuration wherein a dummy resistor is used only when necessary, it is possible to reliably carry out the selection of a defective device, and thus possible to contribute to a loss reduction.

Also, the following is disclosed in JP-A-2004-129413 (FIG. 1). A charge pump circuit includes a voltage source, a boosting capacitor, a holding capacitor, and a diode provided so as to prevent a backflow of a discharge current of a capacitor charged by the voltage source, and reduce the output voltage of the charge pump circuit by the amount of forward voltage. The circuit outputs a voltage value greater than that of the output voltage of the voltage source by utilizing the action of charging the capacitors. The circuit also includes a correcting diode provided so as to increase the output voltage of the voltage source by the amount of forward voltage. This configuration prevents the output voltage of the charge pump circuit from being affected by the forward voltage of the diode.

It is disclosed in JP-A-2010-288444 (FIG. 1) to provide a gate drive device, which drives the gate of an active element with high input capacitance, such as an IGBT or MOSFET, including a semiconductor integrated circuit 4 having an internal power supply circuit which forms an internal power source based on an external power source supplied from an external power supply such as a battery. The semiconductor integrated circuit incorporates a voltage drop suppression circuit, and a drop of the internal power supply voltage of the internal power supply circuit to lower than a minimum operating voltage, and a sharp drop of voltage output to the gate, are suppressed by the voltage drop suppression circuit when an input external power supply voltage drops momentarily to lower than a minimum operating voltage. It is disclosed a gate drive device which can thereby suppress a fluctuation in the internal power supply voltage and output voltage while reducing the number of parts by omitting a bypass capacitor connected in parallel to the semiconductor integrated circuit. It is described that a ZD/R parallel circuit wherein a zener diode ZD and resistor R are connected in parallel to the internal power supply circuit is provided in the gate drive circuit. A description is given, in FIGS. 12 to 15, of a case in which the ZD/R parallel circuit is provided in a regulator circuit which lowers the external power supply voltage.

However, with the regulator circuit 500 of FIG. 8, when there is a momentary voltage interruption or momentary voltage drop, the VREG drops to 0V or drops drastically, as shown in FIGS. 9A and 9B. When the VREG drops drastically, the power supply voltage supplied to the load circuit 70 drops drastically, and the minimum value VREG2 of the VREG falls below the minimum voltage (=VREG1) which enables the load circuit 70 to operate normally, thus preventing the load circuit 70 from maintaining the normal operation. For example, the latch circuit malfunctions such as by the latch being released, as previously described. A description will be given of a heretofore known regulator circuit 600 which, in order to prevent this problem, adopts measures to be able to supply a voltage which enables the load circuit 70 to operate normally even when there is a momentary voltage interruption or momentary voltage drop.

FIG. 12 is a main portion circuit diagram of the heretofore known regulator circuit 600 adopting the measures. A ZD/R parallel circuit 60 which is a reverse current limiter circuit wherein a zener diode 61 and resistor 64 are connected in parallel is connected on the output terminal 69 side (downstream side) of the regulator circuit 500 of FIG. 8. The ZD/R parallel circuit 60 is a circuit which, when VB<VREG0, blocks a current Ib flowing from unshown capacitors of the load circuit 70 to the VB terminal via an unshown body diode (parasitic diode) of the MOSFET 56. The zener diode 61 prevents a backflow, but as the resistor 64 causes a reverse current to flow while suppressing it, it is not possible to completely interrupt the reverse current (current Ib).

Also, the resistor 64 is necessary for supplying voltage to the load circuit 70 until a threshold voltage (of on the order of 0.6V) of the zener diode 61 is reached when the VB rises from 0V, as will be described hereafter. Next, a description will be given of an advantageous effect obtained by providing the ZD/R parallel circuit 60. The threshold voltage (=0.6V) of the zener diode 61 is a voltage when a forward voltage rises and a voltage affected by the diffusion potential of a pn junction.

FIGS. 13A and 13B are diagrams of a behavior of the VB when momentarily interrupted in the regulator circuit 600 of FIG. 12, wherein FIG. 13A is a waveform diagram of the VB, while FIG. 13B is a waveform diagram of the VREG. When the external power supply voltage VB is applied to the external power supply voltage terminal (VB terminal), the operational amplifier 51 operates, thereby resulting in that the potential of the negative terminal 53 of the operational amplifier 51, reflecting the voltage of the positive terminal 52, becomes equal to the voltage (VERF) of the positive terminal 52, and the voltage of the second connection point 68 reaches the reference voltage VREF of the operational amplifier 51. By regulating the gate voltage of the MOSFET 56 into which is input an output voltage output from the output terminal 54 of the operational amplifier 51, a current I0 flowing through the second resistor 66 is regulated so that the reference voltage VREF is generated in the second resistor 66. The voltage of the first connection point 67, being ((the resistance value of the first resistor 65+the resistance value of the second resistor 66)/the resistance value of the second resistor 66)×VREF, reaches a set voltage VREG0. Then, VREG=VREG0−Vp, and the VREG is a constant voltage (VREG0−Vp) in the region of VB≥VREG0. The Vp is a voltage drop Vp occurring in the ZD/R parallel circuit 60.

Meanwhile, when the VB is momentarily interrupted, VB<VREG0, and VB=0V in an extreme case. At this time, electric charge within the load circuit 70 is discharged, and a reverse current tends to flow toward the VB terminal via the ZD/R parallel circuit 60 which is a backflow limiter circuit, but is blocked by the zener diode 61, meaning that the reverse current flows via the resistor 64. When the VB voltage<0, the reverse current flows from the GND into the resistor 64 via the body diodes of the series of currents. Consequently, when VB=0V, VREG=VREG2 rather than VREG=0. The VREG2 depends on the current flowing through the resistor 64.

By setting the VREG2 to be equal to or higher than a voltage VREG1) at which the resistor 64 is optimized to enable the load circuit 70 to operate normally, the load circuit 70 can maintain the operation normally even when there is a momentary voltage interruption or momentary voltage drop.

FIG. 14 is a diagram showing VB dependence of the VREG. This shows VB dependence when the regulator circuit 600 starts operating and stops operating.

VREG=VREG0−Vp when VB≥VREG0. Also, VREG=VB−Vp when VB<VREG0. The drop rate of the VREG decreases when the VB is between the threshold voltage (0.6V) of the zener diode 61 and 0V. This is because a voltage (R×Ir1) generated in the resistor 64 is dominant when the Vp is between these voltages. The VREG is supplied to the load circuit 70. The circle in FIG. 14 is an operating point.

FIG. 15 shows temperature dependence of the VREG. Even when the reference voltage VREF has no temperature dependence, the temperature dependence of the voltage drop Vp generated in the ZD/R parallel circuit 60 is reflected in the temperature dependence of the VREG. The temperature dependence of the VREG becomes positive, and the Vp decreases when the temperature rises, while the Vp increases when the temperature drops.

That is, in the regulator circuit 600 shown in FIG. 12, the VREG is a voltage always lower than the VREG0 by the amount of the Vp in the region of VB≥VREG0. Furthermore, as the VREG, reflecting the temperature dependence of the Vp, has the positive temperature dependence, there is a problem that the VREG is not suitable to be used as a power source when it is desired to eliminate temperature dependence in the output characteristics of the load circuit.

Also, in JP-A-59-96828 (FIG. 2) and JP-A-2004-129413 (FIG. 1), a regulator output is stabilized toward a drop in the external power supply voltage to prevent malfunction of the load circuit, thus enabling a circuit operation even at the low external power supply voltage. Furthermore, no description is given of a regulator circuit wherein the VREG has no temperature dependence so that it is possible to supply a voltage which enables the load circuit to operate normally.

SUMMARY OF THE INVENTION

An object of the invention is to solve the heretofore described problems and provide a regulator circuit wherein it is possible to supply a voltage which enables a load circuit, which is a circuit or a plurality of circuits as a load of the regulator circuit, to operate normally even when an external power supply voltage is momentarily interrupted or drops momentarily, and an output voltage which enables the load circuit to operate normally with no temperature dependence, and a semiconductor integrated circuit device forming the regulator circuit.

In order to achieve the object, according to a first aspect of the invention, a regulator circuit, which lowers an external power supply voltage and supplies the voltage to a load circuit, includes an external power supply voltage terminal; a transistor connected to the external power supply voltage terminal; a first resistor connected to the transistor; a second resistor of which one end is connected to the first resistor and the other end is connected to a ground; an operational amplifier which controls the regulator circuit; and a reference voltage circuit connected to the positive terminal of the operational amplifier. A configuration is such that the negative terminal of the operational amplifier is connected to the connection point of the first resistor and second resistor, the output of the operational amplifier is connected to the gate of the transistor, the output terminal of the regulator circuit is connected to the connection point of the transistor and first resistor, and a backflow limiter circuit connected to and between the external power supply voltage terminal and the transistor is provided.

Also, according to a second aspect of the invention, in the regulator circuit according to the first aspect, it is preferable that the backflow limiter circuit is formed of a parallel circuit of a diode and resistor, or formed of the diode alone, and the anode of the diode is connected to the external power supply voltage terminal.

Also, according to a third aspect of the invention, in the regulator circuit of the second aspect, it is preferable that the diode is a pn diode, a zener diode, or a Schottky diode.

Also, according to a fourth aspect of the invention, in the regulator circuit of the first aspect, it is preferable that the transistor is an enhancement type or depression type n-channel MOSFET.

Also, according to a fifth aspect of the invention, in a semiconductor integrated circuit device, it is preferable that the regulator circuit according to any one of the first to fourth aspects and the load circuit are formed on the same semiconductor substrate.

In the invention, it is possible to provide a regulator circuit wherein it is possible to supply a voltage which enables load circuits to operate normally, even when an external power supply voltage is momentarily interrupted or drops momentarily, by providing a parallel circuit (ZD/R parallel circuit), formed of a backflow prevention diode and a resistor, between an external power supply voltage terminal and the high potential side of a transistor, and a semiconductor integrated circuit device forming the regulator circuit.

Furthermore, it is possible to provide a regulator circuit wherein an output voltage which enables a load circuit to operate normally has no temperature dependence, and a semiconductor integrated circuit device forming the regulator circuit.

BRIEF DESCRIPTION OF THE DRAWINGS

FIGS. 2A and 2B are diagrams showing a behavior of a VB when momentarily interrupted in the regulator circuit 100 of FIG. 1, wherein FIG. 2A is a waveform diagram of the VB, while FIG. 2B is a waveform diagram of a VREG.

FIGS. 4A and 4B show temperature dependence of the VREG, wherein FIG. 4A is a diagram when VB≥VREG0+Vp, while FIG. 4B is a diagram when VB<VREG0+Vp.

FIGS. 9A and 9B are diagrams showing a behavior of the VB when momentarily interrupted in the regulator circuit 500 of FIG. 8, wherein FIG. 9A is a waveform diagram of the VB, while FIG. 9B is a waveform diagram of the VREG.

FIGS. 13A and 13B are diagrams showing a behavior of the VB when momentarily interrupted in the regulator circuit 600 of FIG. 12, wherein FIG. 13A is a waveform diagram of the VB, while FIG. 13B is a waveform diagram of the VREG

DETAILED DESCRIPTION OF THE INVENTION

Figure 1:
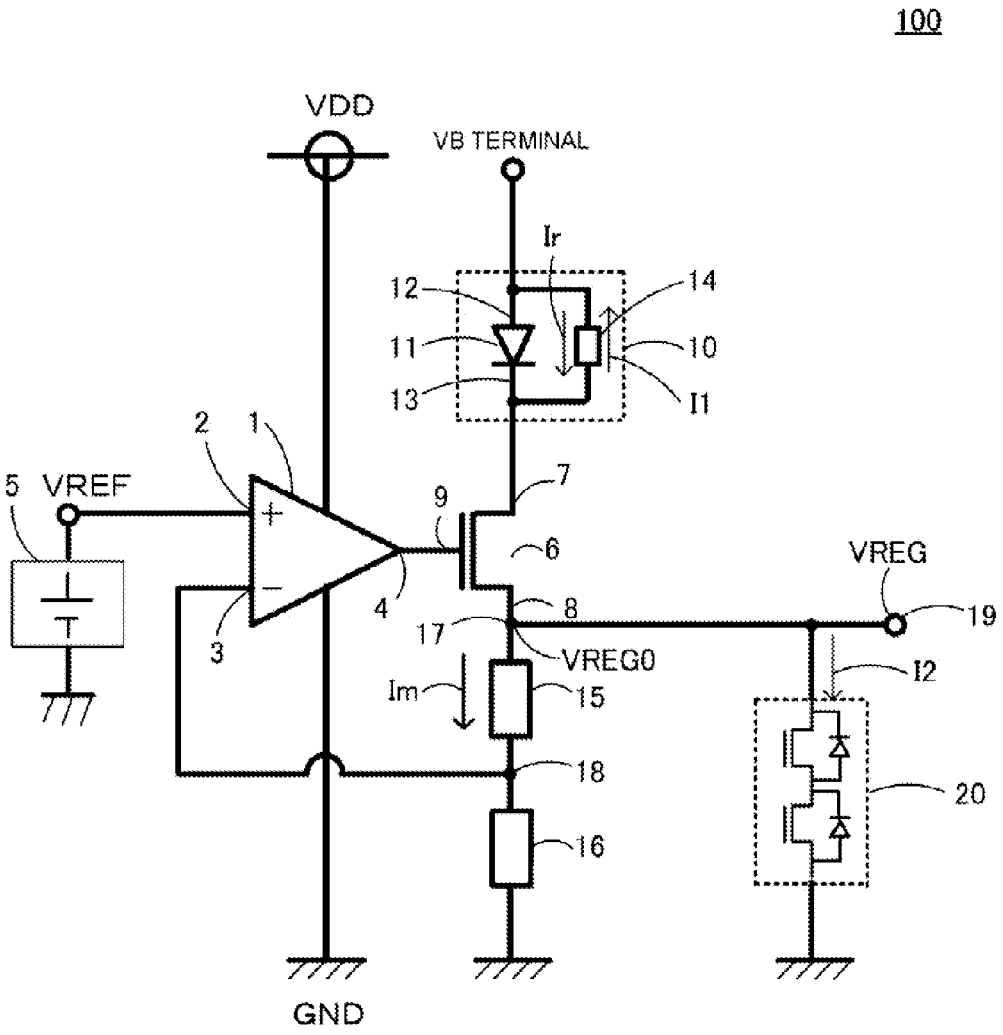
FIG. 1 is a main portion circuit diagram of a regulator circuit 100 according to a first working example of the invention.
Figure 12:
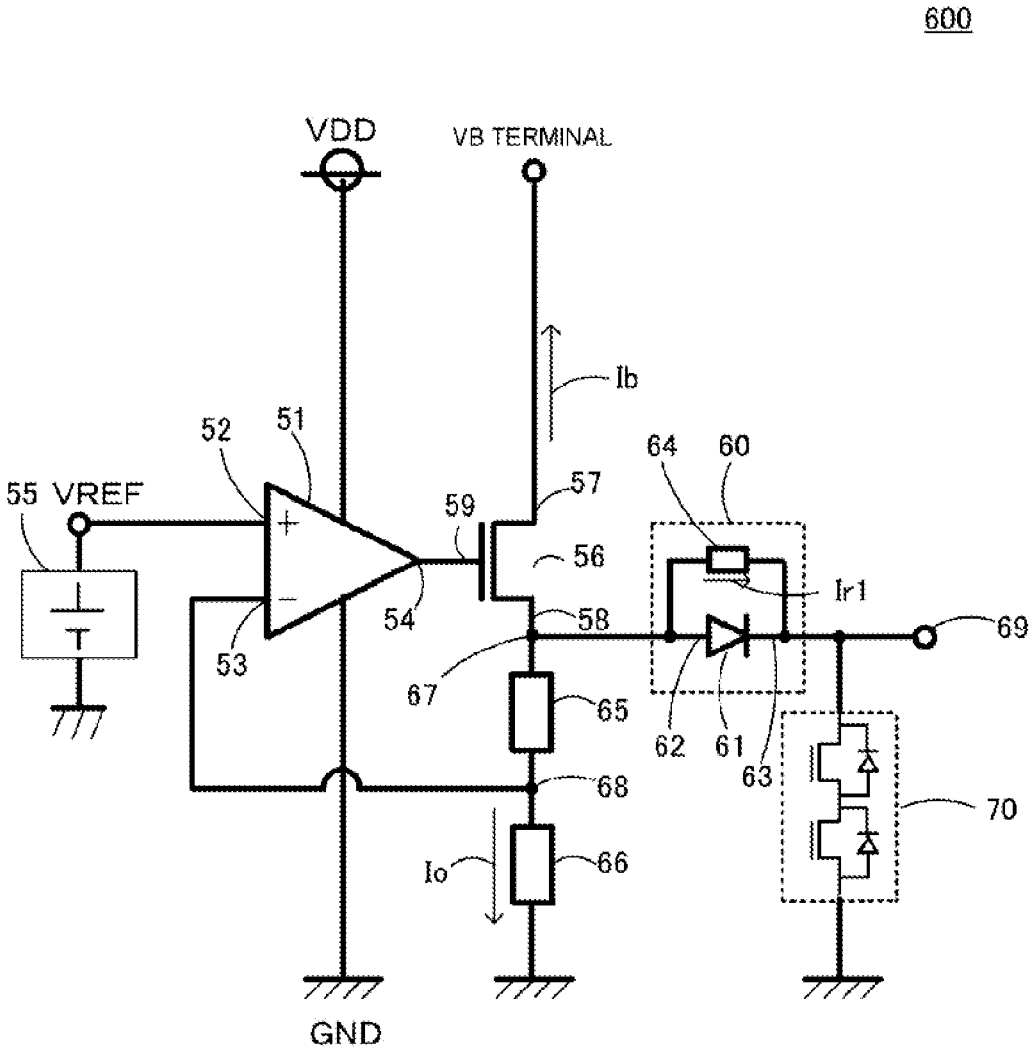
FIG. 12 PRIOR ART
FIG. 12 is a main portion circuit diagram of a heretofore known regulator circuit 600 adopting measures.
Figure 13A:
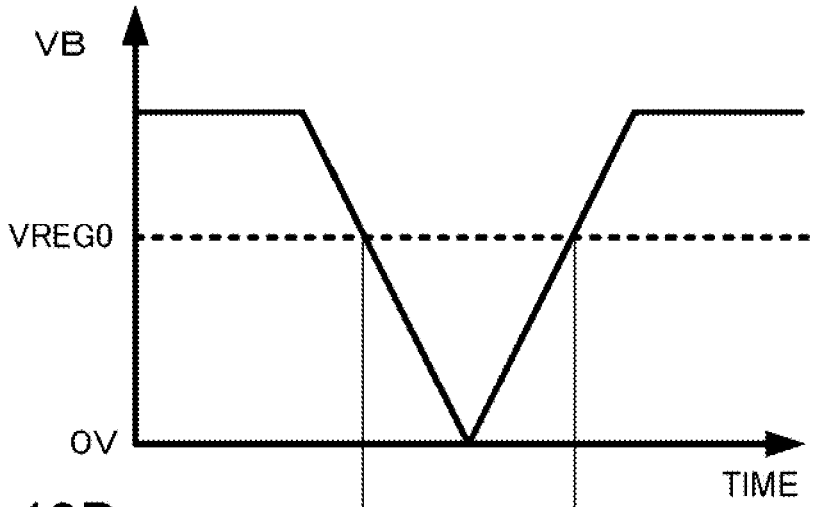
Figure 13B:
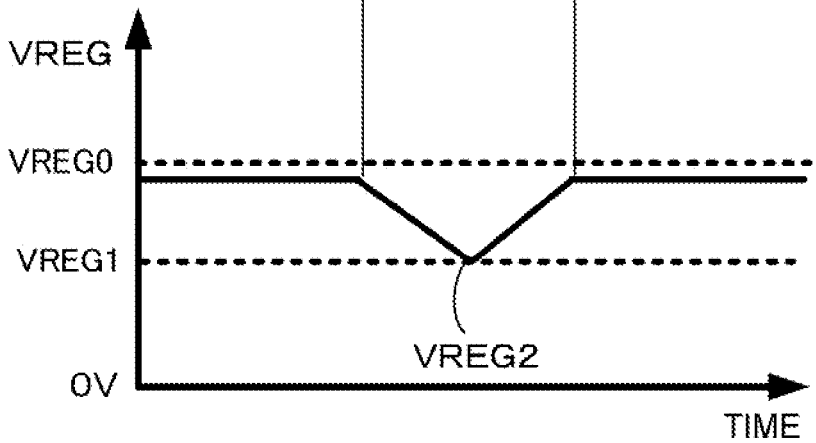
Figure 14:
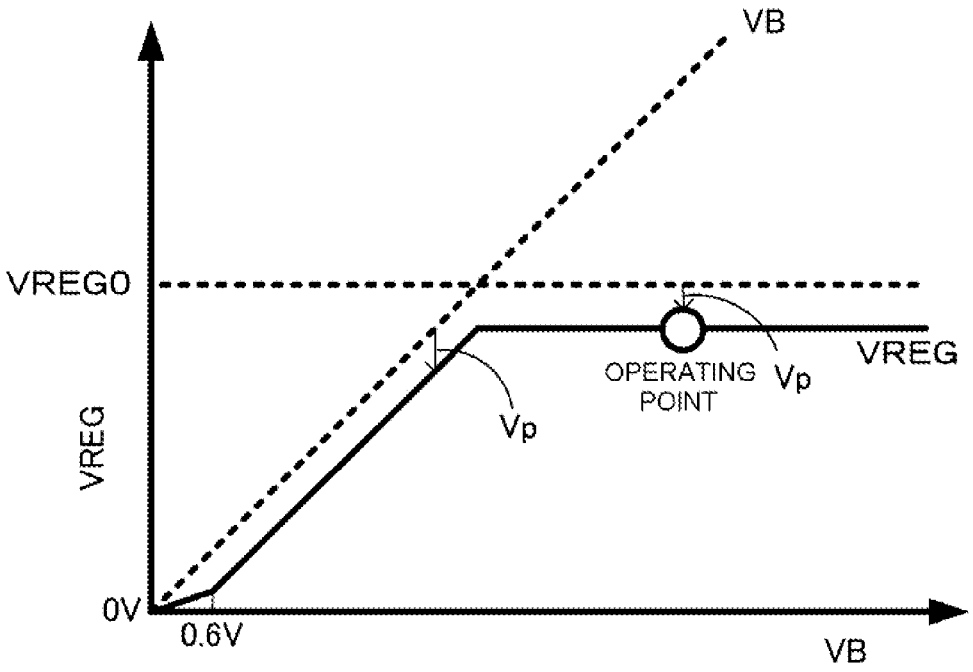
FIG. 14 is a diagram showing VB dependence of the VREG.
Figure 15:
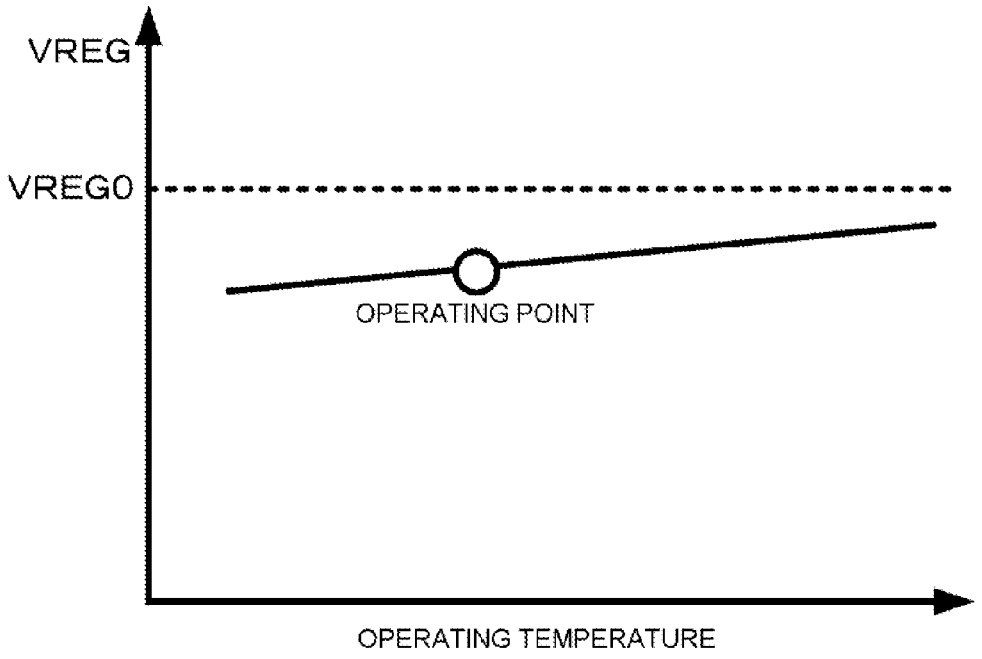
FIG. 15 shows temperature dependence of the VREG.

A First Working Example of a Regulator Circuit According to the Present Invention FIG. 1 is a main portion circuit diagram of a regulator circuit 100 according to a first working example of the invention. The difference from FIG. 12 is that a ZD/R parallel circuit 10 which is a reverse current limiter circuit is disposed anterior to a regulating stage. ZD of the ZD/R parallel circuit 10 is a zener diode 11, and R is a resistor 14.

The regulator circuit 100 includes an operational amplifier 1, a reference voltage circuit 5 connected to a positive terminal 2 of the operational amplifier 1, an MOSFET 6, a gate 9 of which is connected to an output terminal 4 of the operational amplifier 1, and the ZD/R parallel circuit 10 to which are connected a drain 7 of the MOSFET 6 and a cathode 13 of the zener diode 11. The regulator circuit 100 includes an external power supply voltage terminal (VB terminal) connected to an anode 12 of the zener diode 11 of the ZD/R parallel circuit 10, a first resistor 15 connected to a source 8 of the MOSFET 6 (of an enhancement type n-channel type), and a second resistor 16 of which one end is connected to the first resistor 15 and the other end is connected to a ground GND. The regulator circuit 100 includes a load circuit 20, which is a circuit or a plurality of circuits as a load of the regulator circuit 100, connected to a first connection point 17 which is the connection point of the MOM-ET 6 source 8 and first resistor 15, and an output terminal 19 of the regulator circuit 100 connected to the first connection point 17. The connection point of the first resistor 15 and second resistor 16 forms a second connection point 18. A negative terminal 3 of the operational amplifier 1 and the second connection point 18 are connected together. The operational amplifier 1 is connected to a power supply VDD and the ground GND. The ZD/R parallel circuit 10 is a circuit wherein the zener diode 11 and resistor 14 are connected in parallel. Also, it is good to use a band gap reference circuit as the reference voltage circuit 5 because it has no temperature dependence. Also, an ordinary pn diode may be used in place of the zener diode 11. Next, a description will be given of a circuit operation.

a. An external power supply voltage VB is applied to the VB terminal from an unshown external power supply circuit such as a battery.

b. The MOSFET 6 is put into an on-state by operating the operational amplifier 1. The MOSFET 6 is already in the on-state when it is of a depression type.

c. A reference voltage VREF input into the positive terminal 2 of the operational amplifier 1 is reflected in the negative terminal 3, and a current Im flows from the VB terminal via the ZD/R parallel circuit 10, MOSFET 6, first resistor 15, and second resistor 16 to the ground GND so that the reflected VREF is the voltage of the second connection point 18 which is the connection point of the first resistor 15 and second resistor 16. At this time, the voltage of the first connection point 17 which is the connection point of the MOSFET 6 and first resistor 15, being ((the resistance value of the first resistor 15+the resistance value of the second resistor 16)÷the resistance value of the second resistor 16)×the value of the VREF, reaches a set voltage VREG0 of an output voltage VREG of the regulator circuit 100. The VREG is a constant voltage at VREG=VREG0 until the external power supply voltage VB drops to the VREG0. The VREG (=VREG0) is the power supply voltage of the load circuit 20, causing the load circuit 20 to operate normally.

Figure 2A:
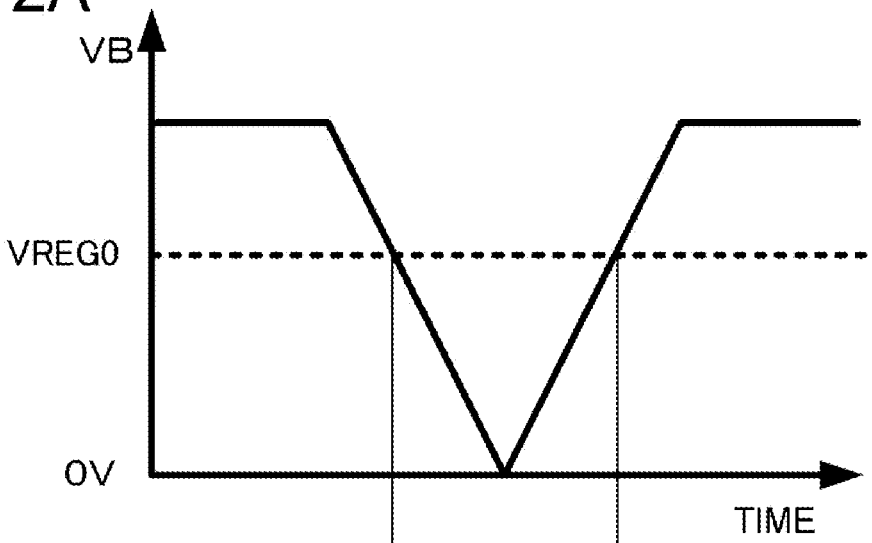
Figure 2B:
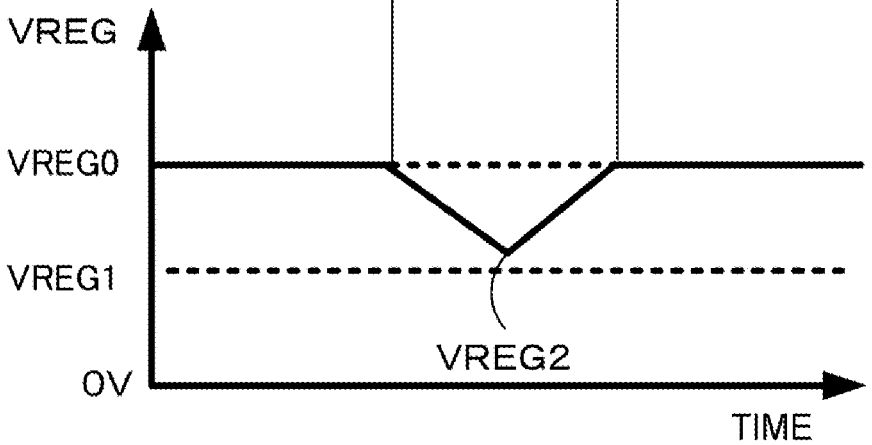

FIGS. 2A and 2B are diagrams showing a behavior of the VB when momentarily interrupted in the regulator circuit 100 of FIG. 1, wherein FIG. 2A is a waveform diagram of the VB, while FIG. 2B is a waveform diagram of the VREG. When the VB is momentarily interrupted, resulting in VB<VREG0, current tends to flow from the load circuit 20 to the VB terminal by way of an unshown body diode (parasitic diode) of the MOSFET 6. However, a current blocked by the zener diode 11 of the ZD/R parallel circuit 10 (a leakage current flows), and suppressed via the resistor 14 connected in parallel to the zener diode 11 (to be exact, the leakage current from the zener diode 11 is added to the current), flows into the VB terminal. At this time, the voltage of the first connection point 17 which is the connection point of the MOSFET 6 and first resistor 15 becomes higher than the VB, and is determined by a current I1 flowing through the resistor 14. When the minimum value of the voltage is taken to be VREG2, the VREG2 is set to be equal to or higher than a voltage VREG1) which enables the load circuit 20 to operate normally. The ZD/R parallel circuit 10 is a backflow limiter circuit which limits a reverse current flowing to the VB terminal.

Figure 3:
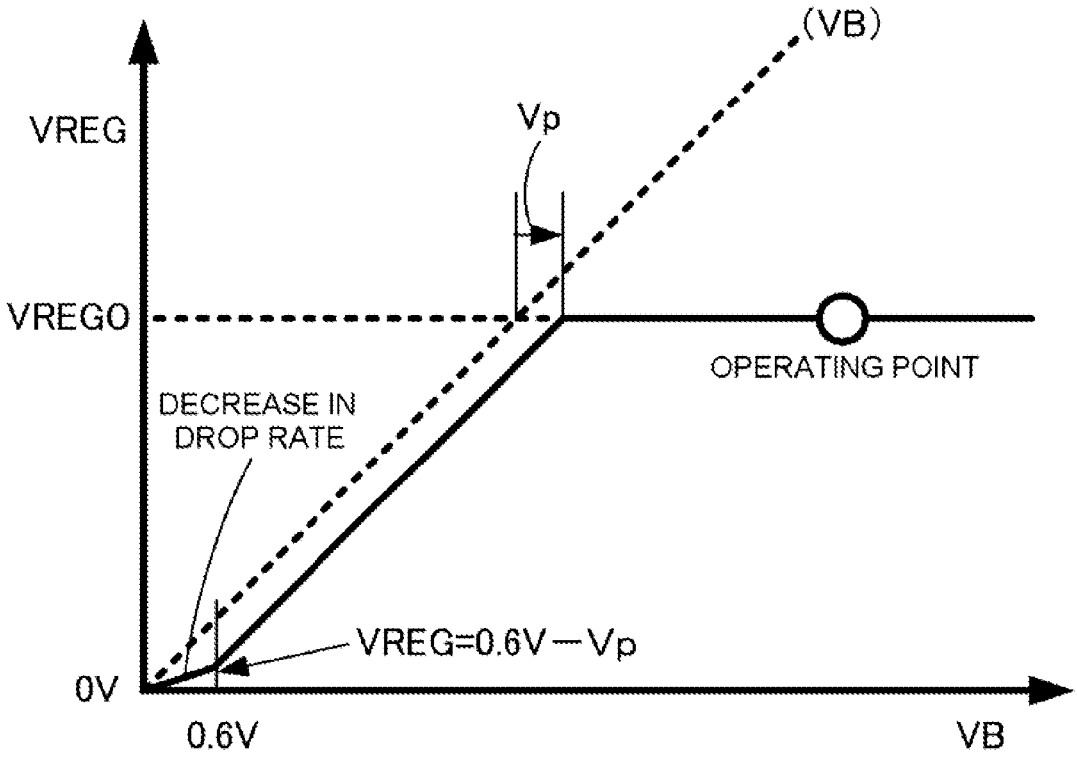
FIG. 3 is a diagram showing VB dependence of the VREG.

FIG. 3 is a diagram showing VB dependence of the VREG. This shows VB dependence when the regulator circuit 100 starts operating and stops operating.

When the regulator circuit 100 starts operating and the VB rises gradually from 0V, the VB rises while maintaining VREG=VB−Vp. VREG=VREG0 when VB≥VGRE0+Vp. The Vp is a drop voltage of the ZD/R parallel circuit 10.

Meanwhile, a description will be given of a case in which the VB drops to 0V from a voltage higher than VREG0+Vp in a stop and transitional state of the regulator circuit 100. VREG=VREG0 when VB≥VREG0+Vp, and in the range of VREG0+Vp>VB=0.6V, the VB drops to 0.6V while maintaining VREG=VB−Vp. The drop rate of the VREG decreases in the range of 0.6V>VB=0. This is because the Vp is lower than a threshold voltage Vth (=0.6V) of the zener diode 11 in this range, and a voltage generated in the resistor 14 (r×Ir: r is a resistance value, and Ir is a current) is dominant. The VREG is supplied to the load circuit 20. The circle in FIG. 3 is an operating point. 0.6V is a forward threshold voltage Vth0 of the zener diode 11 and a voltage at which a forward current starts flowing. The Vth0 is a voltage relating to the diffusion potential of a pn junction, as previously described. The voltage is on the order of 0.6V to 0.7V, but herein, is set to 0.6V. When zener diodes 11 are connected in series, the voltage is 0.6V×the number of zener diodes 11 in series.

Figure 4A:
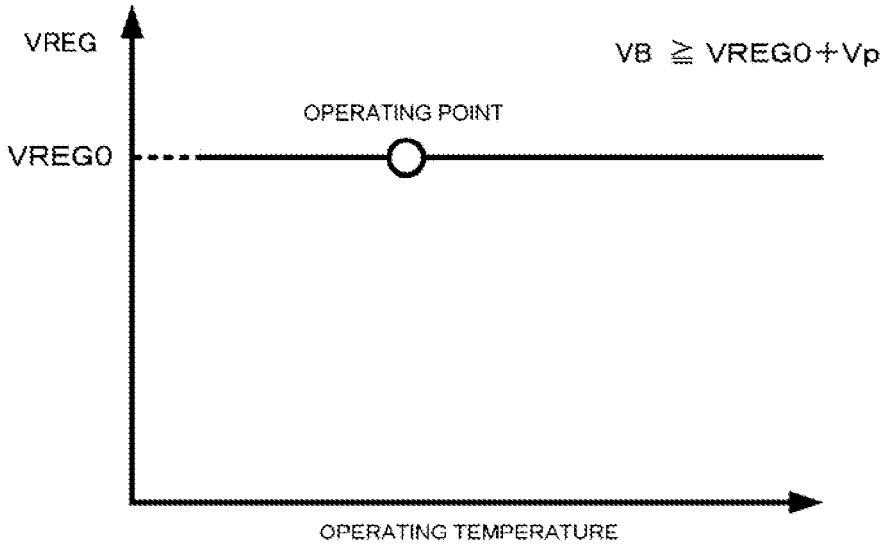
Figure 4B:
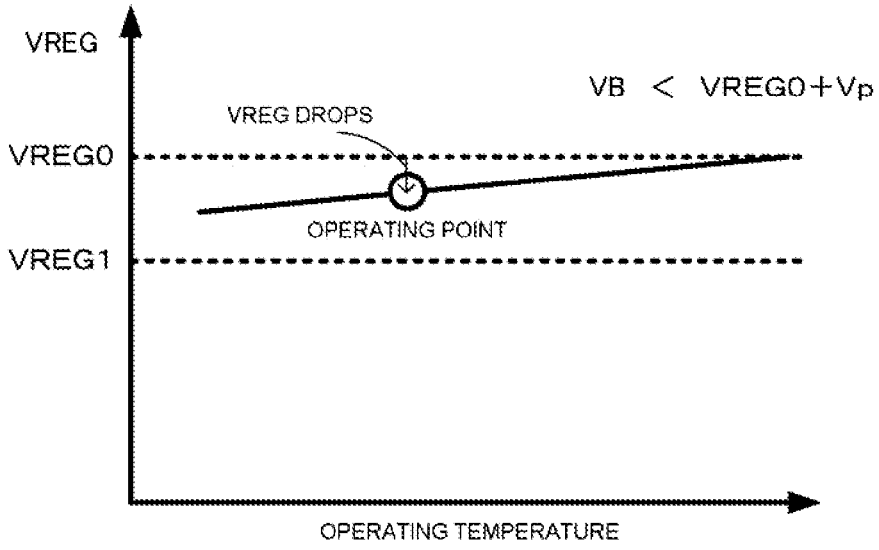

FIGS. 4A and 4B show temperature dependence of the VREG, wherein FIG. 4A is a diagram when VB≥VGRE0+Vp, while FIG. 4B is a diagram when VB<VGRE0+Vp. The temperature dependence of the Vp is reflected in the temperature dependence of the VREG.

When VB≥VREG0+Vp, VREG=VREG0, as shown in FIG. 4A, and the VREG is not affected by the temperature dependence of the Vp. Because of this, the VREG has no temperature dependence and is flat. As the VREG has no temperature dependence, the VREG at the operating point does not drop even when the temperature drops, and the VREG0 is supplied to the load circuit 20, meaning that the load circuit 20 can maintain a normal operation. In this way, the VREG has no temperature dependence in the region of VREG≥VGRE0.

As VREG=VB−Vp when VB<VREG0+Vp, as shown in FIG. 4B, the temperature dependence of the Vp is reflected in the temperature dependence of the VREG, and the VREG at the operating point drops below the VREG0 when the operating temperature drops. However, by optimizing the resistor 14 so that VREG≥VREG1, it is possible to supply the load circuit 20 with a voltage which enables the load circuit 20 to operate normally even when the operating temperature drops.

By adopting the configuration of the first working example, it is possible to supply the load circuit 20 with a voltage (≥VGRE1) which enables the load circuit 20 to operate normally even when the VB is momentarily interrupted or drops momentarily.

Furthermore, an excessive reverse current flowing back from the second resistor 16, the first resistor 15, and the body diodes within the load circuit 20 when the external power supply voltage VB is negative with respect to the ground GND (for example, when a negative surge voltage is applied) can be prevented by the ZD/R parallel circuit 10 from flowing to the VB terminal via the body diode of the MOSFET 6. Because of this, it does not happen that electric charge within the load circuit is discharged, that is, it is possible to prevent malfunction, provided that the momentary voltage drop is for a certain amount of time.

Figure 5:
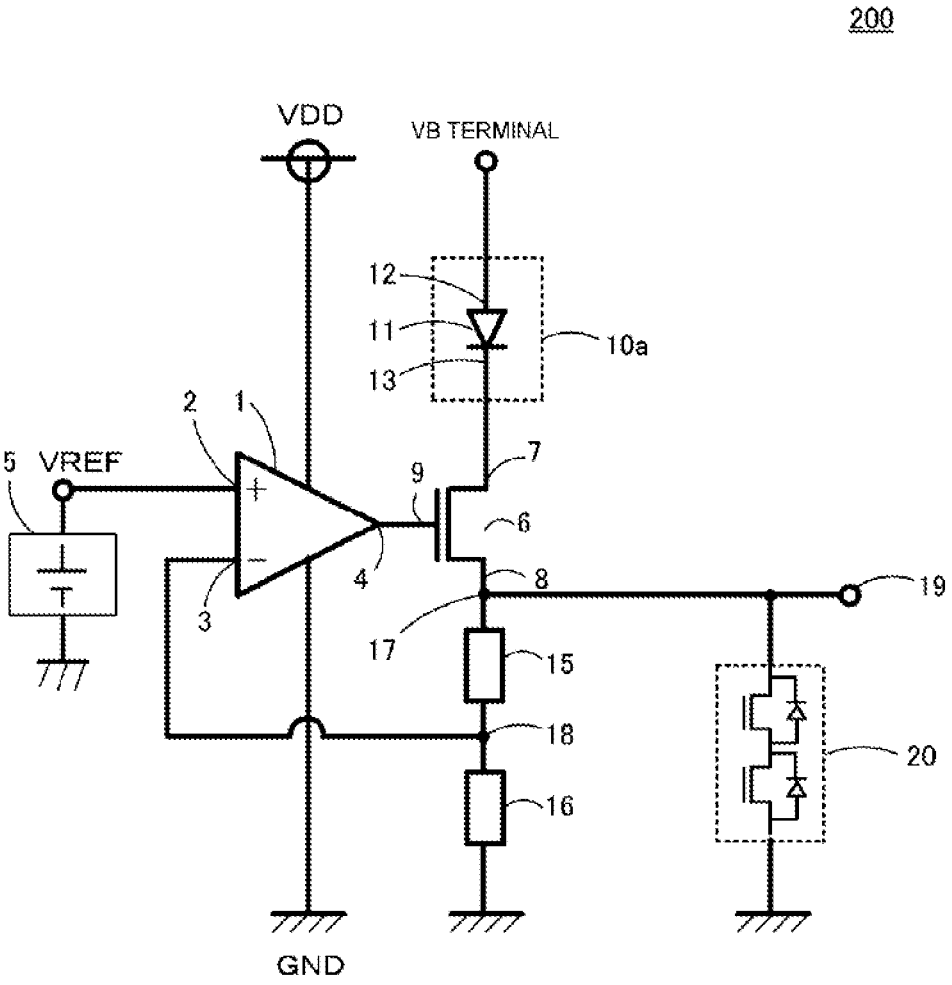
FIG. 5 is a main portion circuit diagram of a regulator circuit 200 according to a second working example of the invention.

A Second Working Example of a Regulator Circuit According to the Present Invention FIG. 5 is a main portion circuit diagram of a regulator circuit 200 according to a second working example of the invention. The difference from the first working example is that the ZD/R parallel circuit 10 which is a reverse current limiter circuit is replaced by a ZD circuit 10*a* configured of the zener diode 11 alone. The advantageous effects are basically the same as those of the first working example, but as the second working example has another advantageous effect, a description will be given of the advantageous effect.

When VB<VREG0, a current flowing into (a current flowing back to) the VB terminal is only the leakage current from the zener diode 11, and it is possible to reduce the current flowing into the VB terminal by the amount of reverse current. However, as there is a kind of disadvantage to be described hereafter, use applications are limited.

Figure 6:
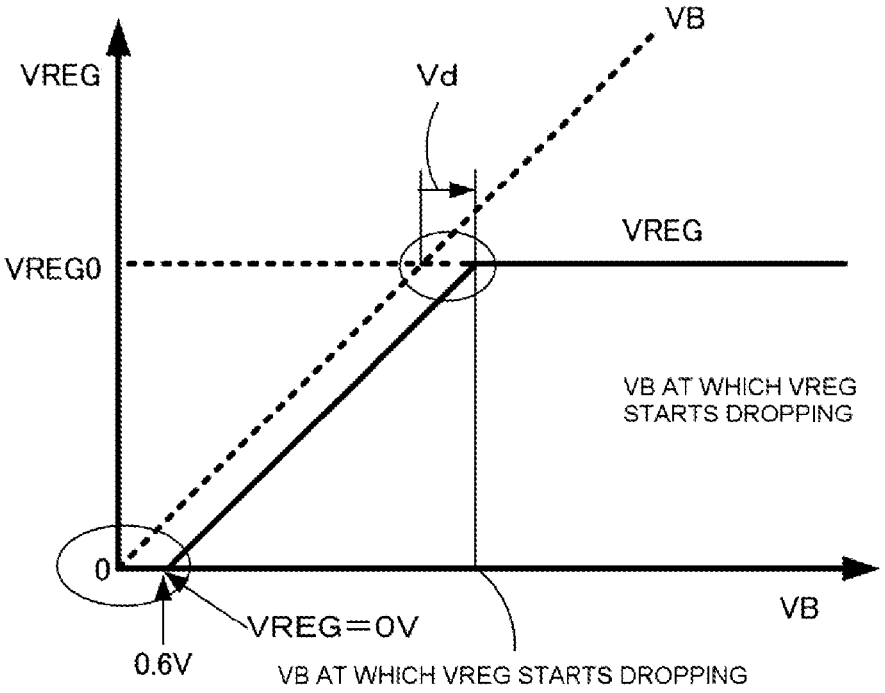
FIG. 6 is a diagram showing VB dependence of the VREG.

FIG. 6 is a diagram showing VB dependence of the VREG. The VREG is almost 0V until the VB reaches the forward threshold voltage Vth0 (=0.6V) of the zener diode 11, and the VREG rises from a point at which the VREG exceeds the threshold voltage Vth0. Because of this, when the VB is a low voltage of 0V to 0.6V, the output voltage VREG of the regulator circuit 200 does not rise, and no voltage can be supplied to the load circuit 20, which is a circuit or a plural of circuits as a load of the regulator circuit 200. Because of this, the VB at which an inconstant state in which the VREG is rising is terminated is higher than in the first working example.

Also, when the VB drops from a voltage higher than the VREG0 and becomes lower than the VREG0, the VREG starts dropping at a point at which VB=VREG0+Vp. In the ZD circuit 10*a*, as a current to which is added the current Ir which has flowed through the resistor 14 is flowing through the zener diode 11, a voltage drop Vd of the zener diode 11 increases, and the Vp increases. As a result of this, the VB at which the VREG starts dropping becomes higher. That is, the region of the VB in which VREG=VREG0 decreases.

As it is possible to make the threshold voltage Vth0 lower than 0.6V (reduce the Vth0 to, for example, a voltage of on the order of 0.4V) by replacing the zener diode 11 with a Schottky diode (SBD), it is possible to terminate the inconstant state, in which the external power supply voltage is rising, at a VB (of on the order to 0.4V) lower than in the previously described case. Also, it is possible to lower the VB at which the VREG starts dropping.

Figure 7:
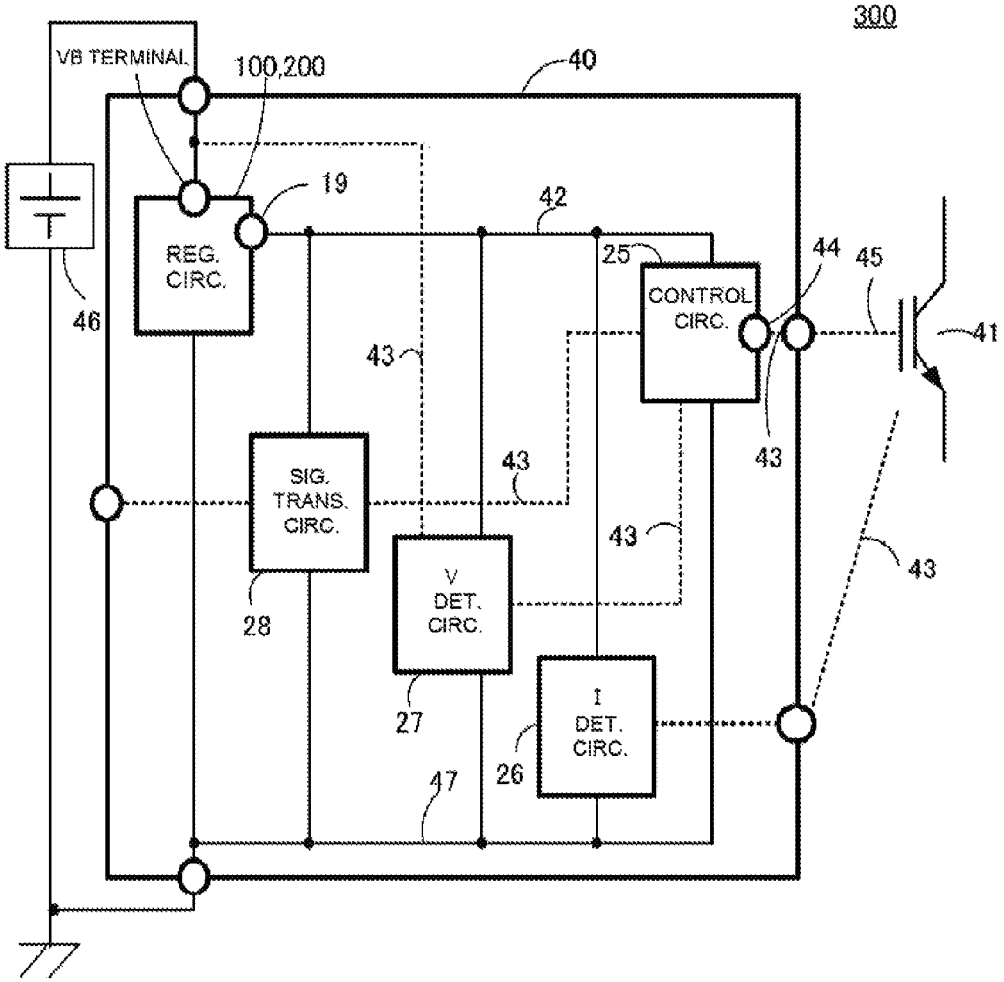
FIG. 7 is a main portion circuit diagram of a regulator circuit 300 according to a third working example of the invention.
Figure 8:
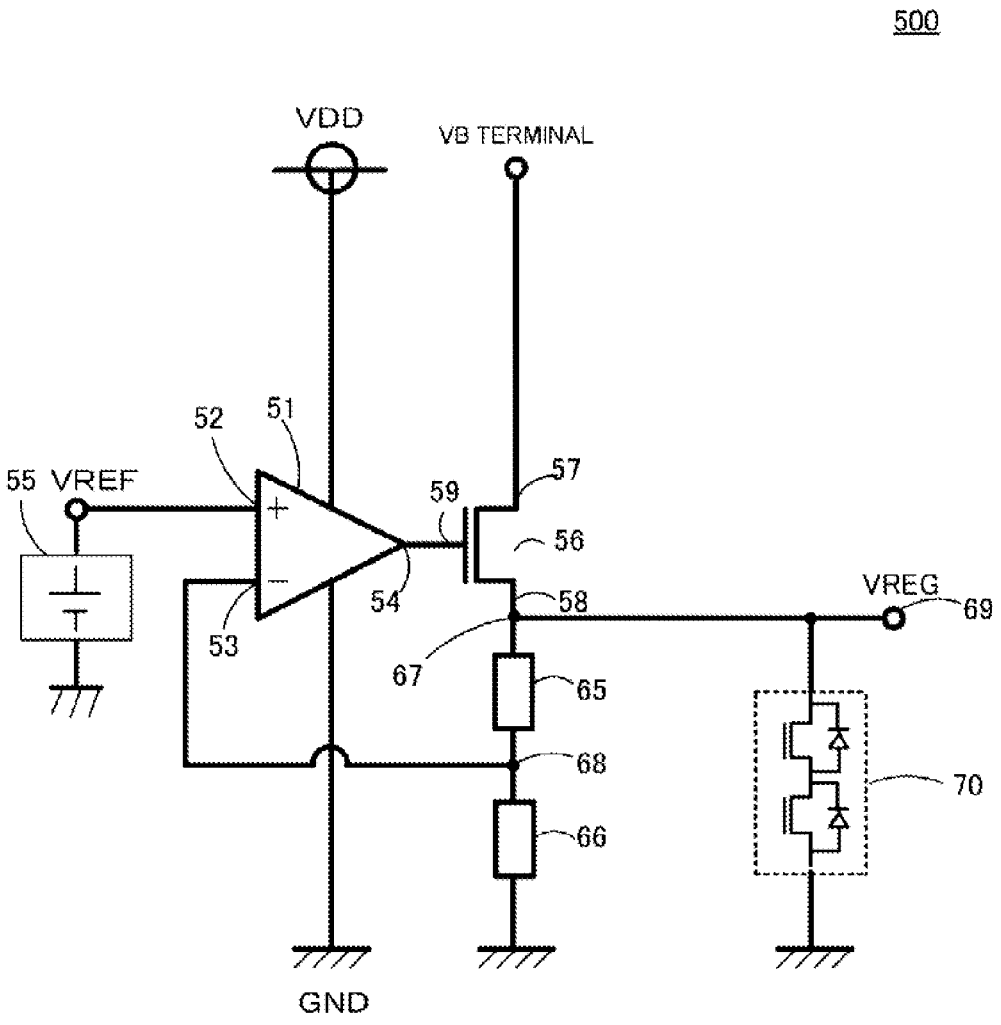
FIG. 8 PRIOR ART
FIG. 8 is a main portion circuit diagram of a commonly used regulator circuit 500 which lowers an external power supply voltage.
Figure 9A:
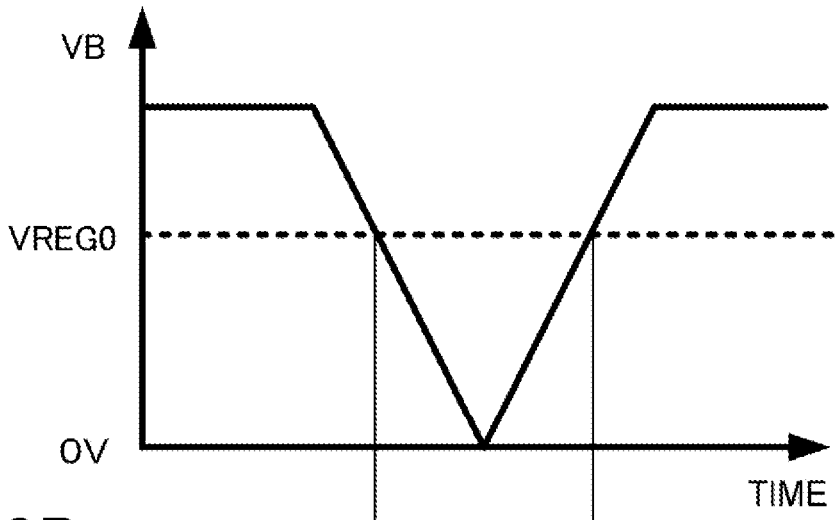
Figure 9B:
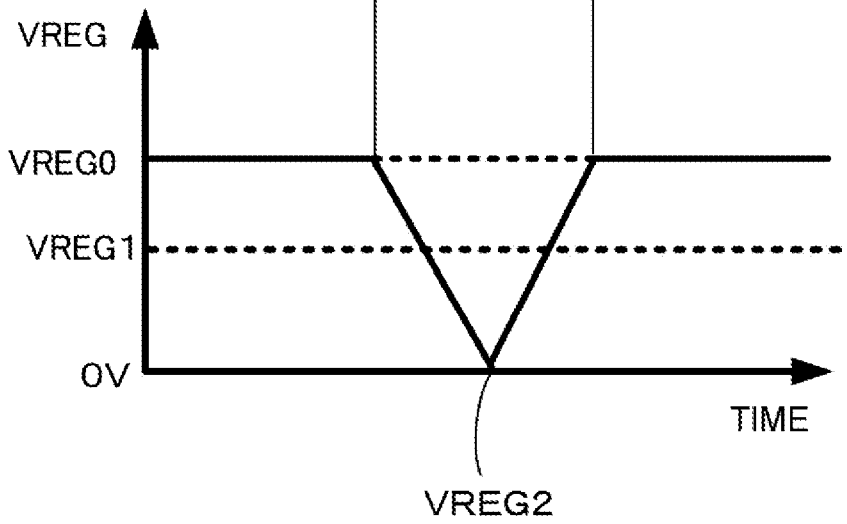
Figure 10:
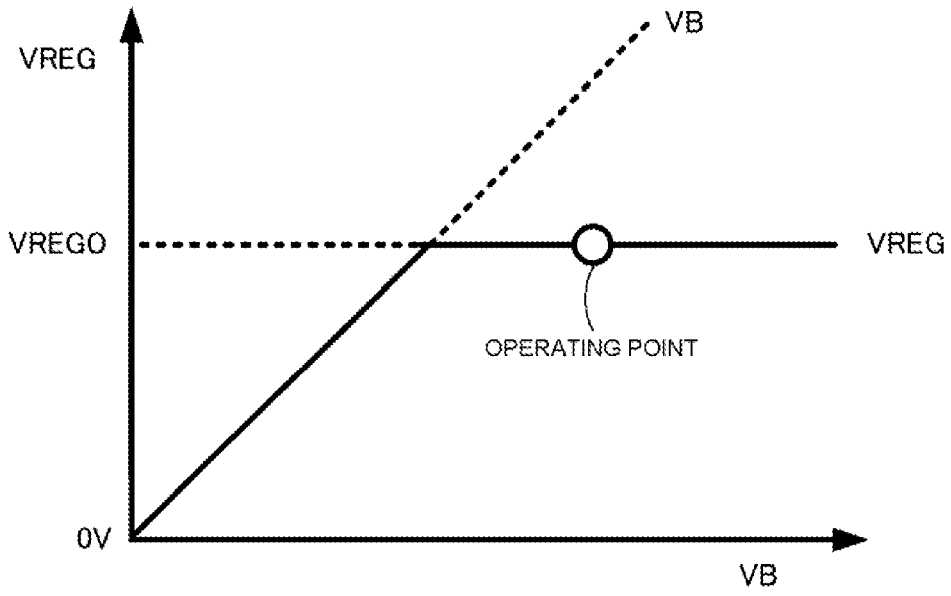
FIG. 10 is a diagram showing VB dependence of the VREG.
Figure 11:
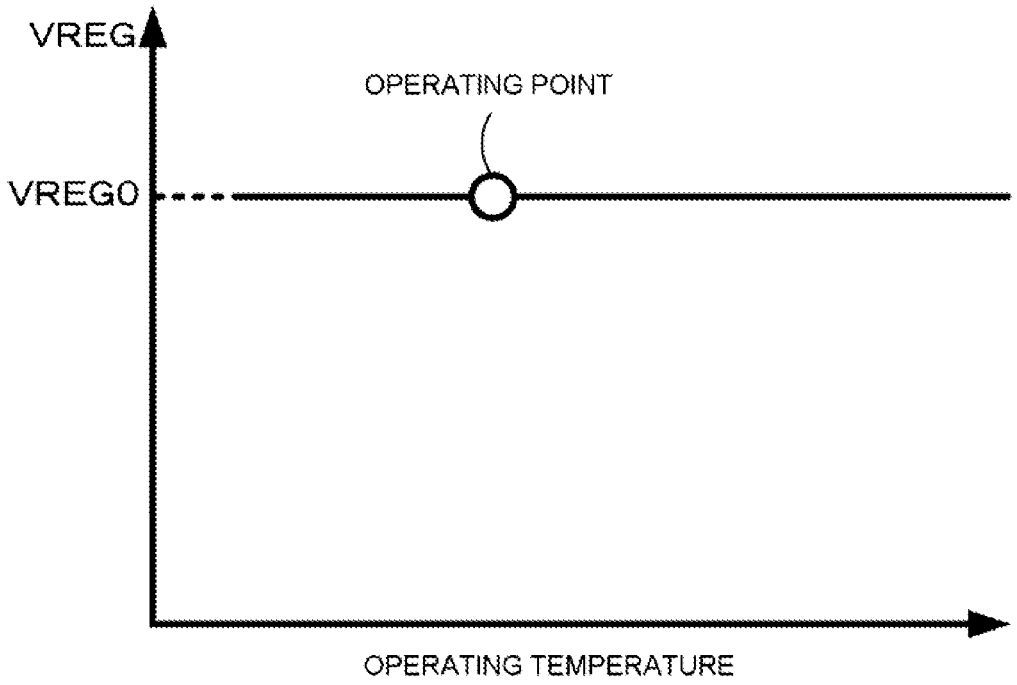
FIG. 11 is a diagram showing temperature dependence of the VREG.

A Third Working Example of a Regulator Circuit According to the Present Invention FIG. 7 is a main portion plan view of a semiconductor integrated circuit device 300 according to a third working example of the invention. The semiconductor integrated circuit device 300 is fabricated by forming on the same semiconductor substrate 40 the regulator circuit 100/200 of the first/second working example and a load circuit 20 such as a control circuit 25 which drives an external power switching element 41 (for example, an IBGT: insulated gate bipolar transistor), a current detection circuit 26 which detects overvoltage and overcurrent of the power switching element 41, a voltage detection circuit 27 which protects the power switching element 41, and a signal transmission circuit 28. The load circuit 20 is a circuit or a plural of circuits as a load of the regulator circuit 100/200. The external power supply voltage terminal (VB terminal) of the regulator circuit 100/200 is connected to an external power supply circuit 46 such as a battery. The output terminal 19 is connected to the load circuit 20 by a power supply wiring 42 shown by the solid line, and the VREG serves as the internal power supply voltage of the load circuit 20. Also, an output terminal 44 of the control circuit 25 is connected to a gate 45 of the power switching element 41, and the power switching element 41 is controlled by an output signal from the output terminal 44.

The load circuit 20 has an unshown logic circuit formed in various kinds of diffusion regions, and the load circuit 20 (control circuit 25 and current detection circuit 26) exchanges signals with the power switching element 41, as shown by dotted lines 43. The various kinds of diffusion regions are a well region, a source region, a drain region, and the like, for forming a MOSFET configuring the logic circuit. Also, the power supply wiring 42 and the wirings shown by the dotted lines 43 are formed from a conductive film, on the semiconductor substrate 40, via an insulating film.

Also, the zener diode 11 and resistor 14 are, for example, formed from a polysilicon film, on the semiconductor substrate 40, via an insulating film, or each formed of a diffusion region in the semiconductor substrate 40.

With the semiconductor integrated circuit device 40 forming the regulator circuit 100/200 of the invention, as the load circuit 20 uses the output voltage VREG of the regular circuit 100/200 as the internal power supply voltage, the load circuit 20 can maintain a normal operation even when the external power supply voltage VB is momentarily interrupted or drops momentarily, and it is possible to reliably carry out a stable drive, detection, and protection of the external power switching element 41 which carries out an exchange of signals with the semiconductor integrated circuit device 40.

Also, a comparatively stable output is possible even for a still longer momentary voltage drop time by utilizing electric charge, with which the gate of the power switching element 41 is charged, for a power supply to the internal circuits while completely suppressing the reverse current flowing when there is a momentary voltage drop by changing the position of the parallel circuit 10 to the drain side of the MOSFET 6.

What is claimed is:

1. A regulator circuit which lowers an external power supply voltage and supplies the lowered voltage to a load circuit, comprising:

an external power supply voltage terminal;

a transistor having first, second, and third terminals, a signal received by the third terminal controlling conduction between the first and second terminals;

a backflow limiter circuit, connected between the external power supply voltage terminal and the first terminal of the transistor, for limiting backflow of current to the external power supply voltage terminal during a momentary drop in the external power supply voltage, the backflow limiter circuit including a diode and a resistor connected in parallel to the diode;

a first resistor connected to the second terminal of the transistor at a first connection point;

a second resistor having an end that is connected to the first resistor at a second connection point and having another end that is connected to ground;

an operational amplifier which controls the regulator circuit;

a reference voltage circuit connected to a positive input terminal of the operational amplifier, and an output terminal for connection to the load, wherein a negative input terminal of the operational amplifier is connected to the second connection point of the first resistor and second resistor, an output terminal of the operational amplifier is connected to the third terminal of the transistor, and the output terminal is connected to the first connection point of the transistor and first resistor.

2. The regulator circuit according to claim 1, wherein the diode has an anode that is connected to the external power supply voltage terminal.

3. The regulator circuit according to claim 1, wherein the diode is a pn diode or a Schottky diode.

4. The regulator circuit according to claim 1, wherein the transistor is an enhancement type or depletion type n-channel MOSFET.

5. The regulator circuit according to claim 1, wherein the diode is a Zener diode.

6. A semiconductor integrated circuit device, wherein the regulator circuit according to claim 1 and the load circuit are formed on the same semiconductor substrate.

* * * * *